US010196187B2

(12) United States Patent
Hingorani

(10) Patent No.: US 10,196,187 B2
(45) Date of Patent: Feb. 5, 2019

(54) AIR-DISPLACING VENTED DISPENSER CAP

(71) Applicant: Arun Hingorani, Sterling Heights, MI (US)

(72) Inventor: Arun Hingorani, Sterling Heights, MI (US)

( * ) Notice: Subject to any disclaimer, the term of this patent is extended or adjusted under 35 U.S.C. 154(b) by 483 days.

(21) Appl. No.: 14/464,208

(22) Filed: Aug. 20, 2014

(65) Prior Publication Data

US 2015/0053725 A1 Feb. 26, 2015

Related U.S. Application Data

(60) Provisional application No. 61/867,841, filed on Aug. 20, 2013.

(51) Int. Cl.

*B65D 47/32* (2006.01)
*B65D 47/08* (2006.01)
*B65D 47/28* (2006.01)

(52) U.S. Cl.

CPC ..... *B65D 47/32* (2013.01); *B65D 47/088* (2013.01); *B65D 47/0838* (2013.01); *B65D 47/283* (2013.01)

(58) Field of Classification Search

CPC .. B65D 47/32; B65D 47/0838; B65D 47/088; B65D 47/283

USPC .... 222/481, 481.5, 482, 478, 562, 559, 563, 222/566, 567, 541.6, 541.9, 153.06, 222/153.07

See application file for complete search history.

(56) References Cited

U.S. PATENT DOCUMENTS 4,241,855 A * 12/1980 Yoshioka ..... B65D 47/0842 222/479
4,523,699 A * 6/1985 Branscum ..... B65D 47/06 222/189.07
5,605,254 A * 2/1997 Wagner, III ..... B65D 47/0842 222/108
2004/0050883 A1* 3/2004 Wagner, III ..... B65D 47/32 222/484
2012/0074180 A1* 3/2012 Kallenbach ..... B65D 47/0804 222/567

* cited by examiner

*Primary Examiner* — Donnell Long
(74) *Attorney, Agent, or Firm* — Jacob M. Ward; Ward Law Office LLC

(57) ABSTRACT

An air-displacing vented dispenser cap for attachment to a dispenser container having a dispenser cap with a liquid dispensing spout outlet and a separate air inlet with a member therebetween defining an air flow passageway to act as a vent for air to enter the inside of the dispenser container on which the dispenser cap would be mounted. By providing an integral air inlet within the dispenser cap, the liquid within the dispenser container can be displaced by air entering the container, such that the flow of egressing liquid will be a smooth flow without the conventional "glug-glug" effect.

18 Claims, 14 Drawing Sheets

AIR-DISPLACING VENTED DISPENSER CAP

CROSS-REFERENCE TO RELATED APPLICATIONS

This application claims the benefit under 35 U.S.C. 119(e) of U.S. Provisional Application No. 61/867,841 filed on 2013 Aug. 20.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED, INCLUDING ON A COMPACT DISC

Not Applicable

BACKGROUND OF THE INVENTION

1. Field of the Invention

The present invention relates to a container dispenser cap, and particularly relates to an air-displacement dispenser cap to attach to a container for smoothly dispensing fluids or particulate materials therethrough without experiencing the well known "glug-glug" effect.

2. Description of the Prior Art

Conventional dispenser bottles with distally located, customer created, vent holes have been the standard for promoting a solution to the problem of expansion and contraction leading to air lock when dispensing liquids from a bottle or container. Prior art caps do not allow the smooth pouring out of contents from a container because an air lock is created. There is no way for the liquid to be displaced by air without a vent to replace the liquid being dispensed by air from outside the container. Such an air lock situation is commonly known as the "glug-glug" effect, which can be explained as intermittent flow alternating between flow output and air input.

In addition, another problem which is still unaddressed in the commercial arena is that once an opening in the container is pierced or created in the top of the container to make a vent in order to equalize the pressure and allow for smooth flow of the liquid being dispensed, the dispensing container must remain laying down with the vent hole facing up and cannot be stood up again without spilling liquid out of the pierced vent hole. Prior attempts at addressing this problem have included additional re-sealable orifices in the top of the dispensing container to allow air displacement, yet provide sealing when the container is situated differently. It would be an advantage to the industry to have a true self-venting cap, although none has heretofore been disclosed. The present invention solves this problem nicely.

U.S. Pat. No. 6,470,910 issued Oct. 29, 2002 to Blackbourn et al. discloses close prior art with a tap comprising a body having a liquid flow passageway between a liquid inlet and an air flow passageway. However, Blackbourn et al. discloses a valve seat controlling liquid and air flow in the passageways operated by a push button. When the air inlet and the liquid outlet are coincident, the valve seat is near the liquid outlet. However, when the air outlet and the liquid inlet are coincident, the valve seat will be at the liquid inlet. This differs significantly from the present invention because there are overriding structural differences as well as functional differences because the additional openings and holes manipulate and control the rate of flow by utilizing the number of locations and sizes variabilities of the size openings between the two taps. These differences include the fact that the present invention does not include a valve seat or plunger seal.

U.S. Pat. No. 6,401,752 issued on Jun. 11, 2002, also to Blackbourn et al. discloses a different aspect of the invention described above. This invention also discloses a tap and valve configuration which is structurally and functionally different from the present invention, as described above.

SUMMARY OF THE INVENTION

The present invention provides a new self-venting, air-displacing, and pressure-equalizing, pouring cap with a pouring spout for incorporation into almost any type of dispensing container, such that when the contents of the dispensing container are drained out in an effluent stream, the operation goes smoother. This new design provides a self-venting pouring cap device for a container that includes an orifice configuration which permits air pressure equalization to prevent the "glug-glug" effect as the effluent stream leaves the dispensing container by self-venting with air through the spout. This self-venting spout cap equalizes the pressure inside and outside the dispensing container, so the pressure remains constant, thereby essentially preventing the "glug-glug" effect. Further, this new self-venting cap will re-direct any spillage/seepage back through the downspout of the self-venting pouring cap into the effluent stream leaving the dispensing container, through the pouring spout, so that the spillage/seepage also ends up where you want it, i.e. in the flow stream.

Heretofore, to the knowledge of the inventor, no one has achieved this solution. Providing a simple-to-manufacture, uncomplicated, yet perfectly sealing self-venting pouring cap that provides air pressure equalizing has been a goal in the industry for a long time. The inventor believes that he has solved this problem with this new and novel design for his self-venting, air pressure equalizing dispenser port that is easy to manufacture, easy to assemble and easy to apply. It is believed that this self-venting, air-displacing dispenser port cap is highly effective and enduring.

In practicing the present invention, and by manipulating the number, location and variability of each of the vents, variable control of the flow rate of the effluent can be effectuated. These vents may also be self-regulating and suitable for fluids, powder and solids in containers that need to be oriented in any direction. The ratio of the cross-sectional area of the liquid dispensing spout outlet to the cross-sectional area of the separate air inlet may be variable, especially useful is when the ratio is larger than 1.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE INVENTION

Therefore, in accordance with the present invention, a new and novel air-displacement dispenser cap is disclosed that allows for smoother dispensing of fluids out of a dispensing container. This invention provides a much long sought after solution to this problem when dispensing fluids from a sealed container. When a container holds liquids for delivery, the container must be airtight or else the contents will come out. However, as mentioned above, getting fluids out of an airtight container can prove to be problematic. As mentioned above, the very least of one's problems is an annoying "glug-glug" effect when dispensing. Equalizing the air pressure inside the container to the air pressure outside the container is needed to provide smooth dispensing.

Figure 1A:
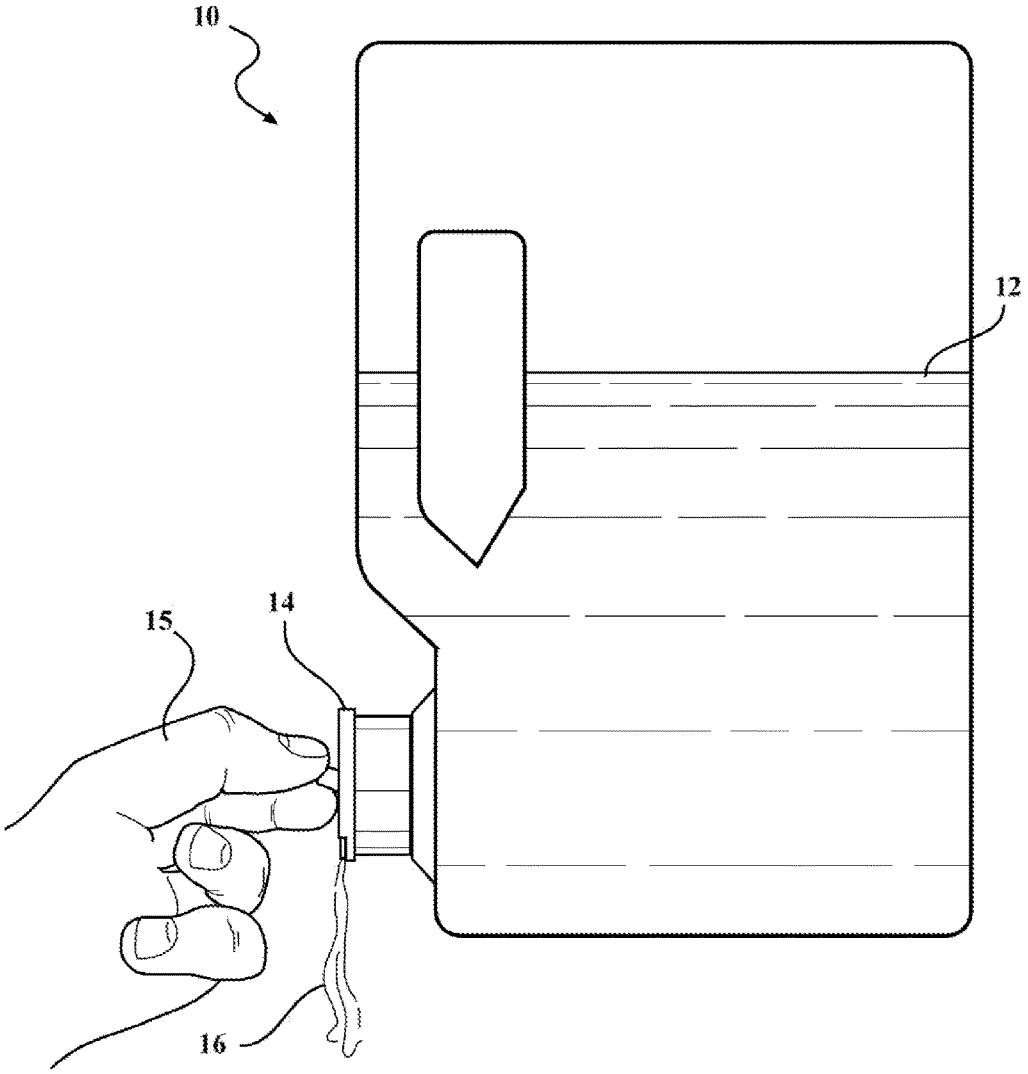
FIG. 1A PRIOR ART
FIG. 1A is a side elevational view of a prior art liquid container.
Figure 1B:
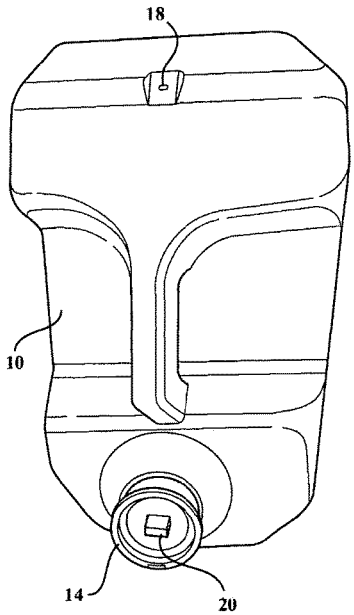
FIG. 1B PRIOR ART
FIG. 1B is a front elevational view of prior art liquid container.
Figure 1C:
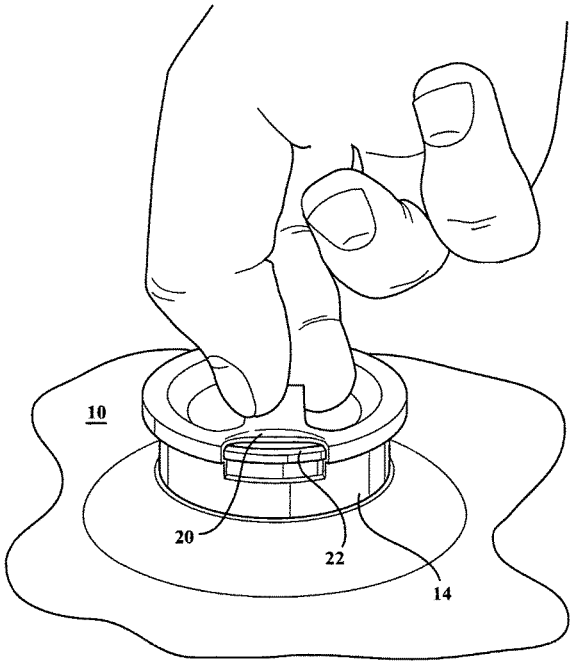
FIG. 1C PRIOR ART
FIG. 1C shows a prior art dispenser tap being used.

Referring collectively now to the set of prior art drawings labeled FIG. 1A-FIG. 1E, one can see that FIG. 1A illustrates a side view of a commercially available and widely used conventional prior art type of dispensing container device in a conventional environment. The dispenser container is generally denoted by the numeral 10. Inside dispensing container 10 is a liquid 12, capped off by dispensing spout 14. Operator 15 can push up or down on the spout 14, thereby releasing effluent 16 out of the dispensing container. The spout 14 is placed at the bottom like a traditional sealing cap. FIG. 1B illustrates a frontal perspective view of dispensing container 10, and shows the relative placement of dispenser spout 14 along with the operative release tab/valve 20. Now looking to FIG. 1C, careful inspection reveals the spout 14 is being operated by a user pushing up on the release valve 20 to open a dispensing orifice 22.

Figure 1D:
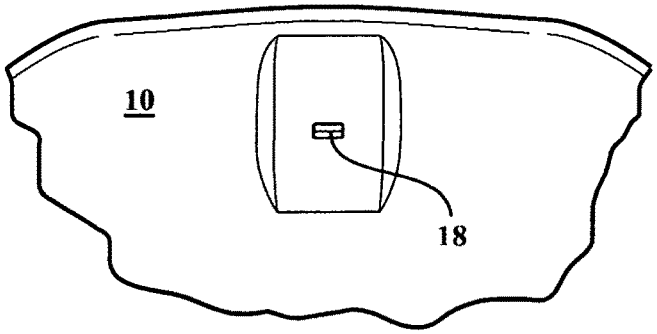
FIG. 1D PRIOR ART
FIG. 1D shows a vent hole made in a prior art liquid container.
Figure 1E:
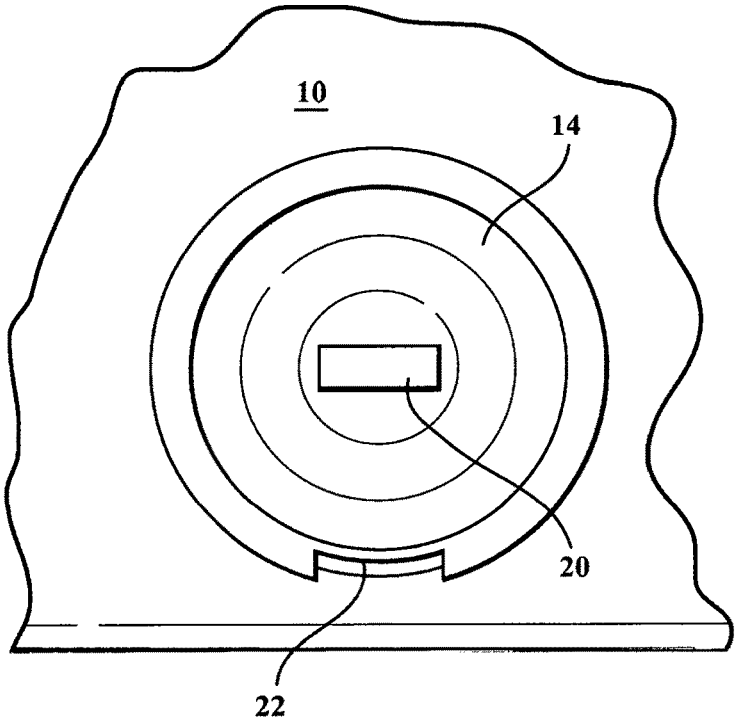
FIG. 1E PRIOR ART
FIG. 1E is a front view of the prior art dispenser tap of FIG. 1C.

Looking now to FIG. 1D, one can see that in order to equalize the pressure in this prior art device, an air vent must be provided. In order to accomplish that in this instance, there is a "pierce here" marking 18 at the top to indicate the preferred place to punch a hole into the container to provide an air-displacing vent. If the container is not pierced, a partial vacuum is created when the contents of the dispensing container begin to be released, and the liquid will not come out of the bottom spigot smoothly, and eventually stop, even though an operator is holding it in the "open" position. FIG. 1E is a frontal elevated view of the prior art spout 14, showing the spout in its closed position.

Further, as one might realize after using one of these traditional water jug containers, once the "pierce here" hole has been punched into the container, there typically isn't a mechanism for re-sealing the "pierce here" hole. This means that the container cannot be stood back up without spilling a continuous stream of water out of the hole, at least until the level of the water is as low as the hole is. Only then will the spilling stop, and that is unacceptable. However, this is the current state of the art.

The inventor has designed his new, useful and non-obvious air equalizing, self-venting spout/cap to allow the dispenser to dispense its contents without requiring any further venting, so that efficient dispensing is now possible for many different varieties of containers and for dispensing many different types of dispensable materials.

Now we will look at the inventor's many faceted solutions to these problems. Since his inventive concept of air-displacing or self-venting features in the dispensing port cap(s) can be utilized in many aspects, we will first examine a multitude of dispensing spigots, ports, or caps that are amenable to using his invention for dispensing liquids or flowing particulate materials. Examples of dispensable liquids are prevalent in the bottled water and laundry detergent art area. Other examples are common in the containers for water-based drinks, wine, or syrup dispensing. Further aspects will find particular utility in a drinking vessel, where a self-venting spout would allow for more even outflow of the drink inside, without having the "glug-glug" circumstance.

Each aspect of the present invention fundamentally includes an air-displacement dispenser vent cap including at least two venting orifices. At least one of the orifices will be the primary orifice, and it shall face outwardly from the liquid in the container, ready to pour out the contents. Further, there will be at least one secondary orifice that is in environmental communication with the outwardly facing orifice to equalize the air pressure between the outside of the container and the inside of the container. As will be described in greater detail hereinbelow with regard to the various Figures, these orifices can have many aspects and/or configurations. Regardless of their configuration, they all perform the substantially equivalent function, i.e. that of providing an air passage to permit air displacement through the dispenser cap itself to equalize the pressure.

In many of the aspects of the present invention, the outwardly facing orifice(s) will be the larger of the orifices. This difference in size has certain advantages, including the fact that any seepage back out of the secondary orifice(s) will be directed through the main opening and guided into the container that the effluent is being drained into. In other words, the smaller secondary opening will leak back down through the larger opening when pouring, so any leakage ends up in the effluent/primary stream, and ultimately ends up where it is supposed to be.

The ratio in the net free area between the smaller and the larger orifice(s) may not be limited, but may be from 1:0.0001 up to 1:1,000,000. By varying the relative sizes of the orifice(s), control can be obtained. This control can be manifested due to the air openings being moderated with a range of opening action, i.e. the openings can be exposed gradually or all at once. Choosing when, which and how many openings are activated will provide dispensing control to the operator.

Also in many aspects of the present invention, a second cap is used over the dispensing spout to close and seal the dispenser opening to prevent leakage and spillage. This second cap may be self-venting or self-closing, or there may be supplemental vents and/or nipples that may be used to reseal openings in the cap. Such caps may have closure possibilities that can be selected from the group consisting of a flex cap, a flip cap, a twist cap, sliding caps, rocker caps, push-pull caps, linear caps, and/or combinations thereof. These caps can also be activated mechanically, pneumatically, hydraulically, electrically, and/or combination thereof.

Further features of the present invention include the fact that the inventor's air-displacement dispensing cap may be self venting, or it may become self venting by using variable size orifices and may include multiple air vents. These multiple air vents may be located in multiple locations, such as on the top of the spout, on the sides of the spout, or in other desirable locations with relation to the spout. By manipulating the number, location and variability of each of the vents, variable control of the flow rate of the effluent can be effectuated. These vents may also be self-regulating and suitable for fluids, powder and solids in containers that need to be oriented in any direction. Containers that need to be laid down would benefit from the use of the present invention. Further, the present invention provides suitability for fluids under pressure in a container, or for applications where shape or design flexibility is necessary.

When specifying the engineering materials for manufacturing the present invention, certain considerations must also be put into place for various material properties. Suitable materials for the self-venting caps, the sealing caps, or the resealable caps may really include any desired material, including plastics of any Durometer, rubber-like materials, metals including aluminum, any iron-based alloy such as stainless steel, titanium or any suitable metal, polymers, ceramics, or any other suitable material that may be desired for a particular application. The overall concept of the self-venting cap can accommodate any material. Further, any combination of materials is also envisioned by the inventor and is also deemed to be within the scope of the invention.

For example, a dual durometer material might be used for a self-closing vent or port. Durometer values of from 10 SHORE A to 140 SHORE D may prove to be useful for the entire cap construction, or a first durometer material having a durometer value of from 10 SHORE A to about 140 SHORE D may be overmolded, spin welded or otherwise made integral by assembly with a durometer value material of from about 10 SHORE A to about 140 SHORE D for the best result. The material it is constructed from is mostly irrelevant, so long as it is not so soft as to allow the vents to crush, thereby blocking the vent and preventing airflow.

Hence, since flexibility may be important for the vent, certain aspects of it may require a softer or a stiffer material. Depending upon the fluid that is being dispensed, various materials will be suitable for dispensing fluids under pressure. Other considerations include shape flexibility and design flexibility. Self cleaning features for openings or sterile materials may be required, depending upon the application. Moreover, depending upon the application, there may be a need for a seal over the spout cap. Many times, a product must reach its ultimate customer with clear and present evidence that the seal has been unbroken, and the product needs to be perfectly sealed for freshness or to show a total lack of tampering. For circumstances that require security issues, or for health inspections, specific tamper evidence features may also be included.

Many of these features permit the container to be laid down on its side after opening the container. This invention may include pouring spout configurations in the cap that are made in different shapes, such as round, triangle, square, pentagonal, or any other desirable shape. Accommodations can be made for nearly any shape that is needed for the packaging.

For larger dispensing containers or for industrial applications, opening and closing mechanisms may be activated remotely by any means including mechanical, electrical, hydraulic, pneumatic and/or a combination or any other type of suitable activation means. The activation means and device may be selected for the particular application needed. For example, a tote-sized industrial dispensing container may find it useful to incorporate the present invention, with a sealing cap over the self-venting spout that is possibly mechanically, electrically or pneumatically controlled. The present invention can be adapted to any activation device that is commercially available, as the sealing cap is predominantly a separate mechanism merely used to close off the formed self-venting cap. The sealing cap is preferably water tight, and is a separate piece to cap off the dispensing spout. Any number of conventional designs for the sealing cap may be used to block the flow of effluent from leaving the dispensing container.

Figure 2A:
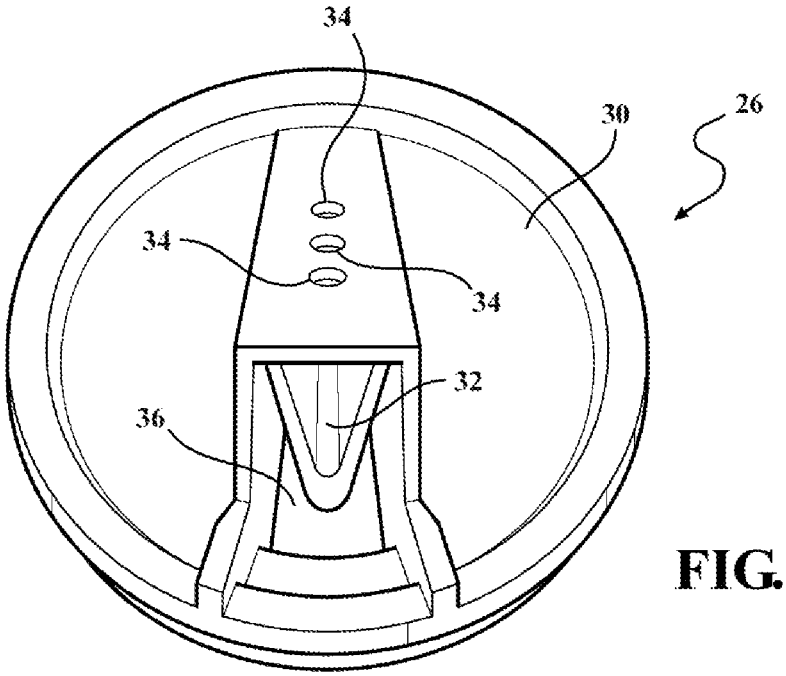
FIG. 2A is a rear view of an air-displacing vented dispenser cap made in accordance with the present invention.
Figure 2B:
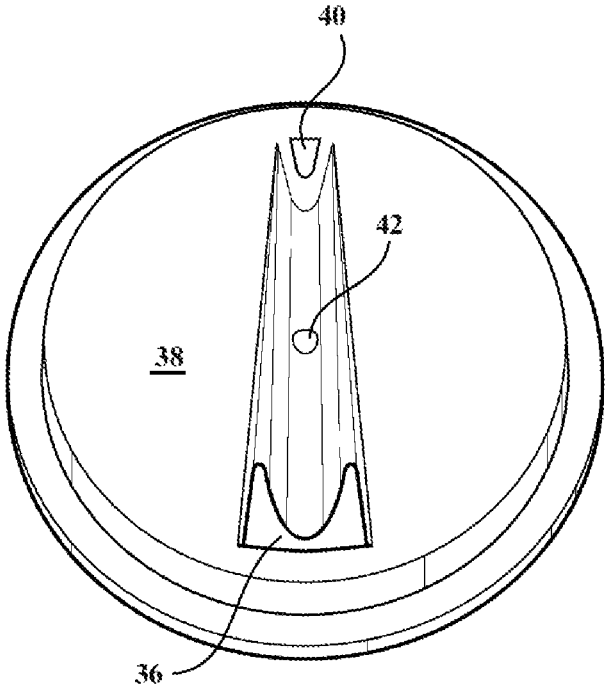
FIG. 2B illustrates vent holes for air displacement.

Looking collectively now to FIGS. 2A and 2B, a first aspect of the present invention is illustrated. In FIG. 2A, the self-venting cap is shown from the front as a front elevational view and is generally denoted by the numeral 26 and includes primary and secondary self-venting ports 32 and 34, respectively, formed into cap face 30. Primary vent 32 is located within pouring spout 36 such that when the effluent flows out the pouring spout 36, air is able to ascend up through primary vent 32 through the front of the cap, and the air bubbles will then travel up into the dispensing container through the backwardly facing vent holes 40 and 42 as shown in FIG. 2B. The air bubbles that traveled up into the dispensing container will rise to the highest point in the container and equalize the air pressure between the inside of the container and the outside of the container during pouring. This prevents the ever present "glug-glug" effect.

Note that the location of the primary vent within the cavity created by the pouring spout means that the primary vent is not physically blocked from access to the environmental air while the effluent is pouring out of the spout. The effluent pours out of the spout around the primary vent, so the vent is not blocked by the effluent. This is why the air, which is necessary to displace the volume within the dispensing container, can be vented up the primary vent into the dispensing container through the secondary vents to rise up to the high point. Once the air bubbles rise to the high point, the pressure is equalized, and the effluent can smoothly flow out. As mentioned before, the primary vent is preferably much larger in its net free area than the sum of the net free area in the secondary vents. This differential ratio, of from 1:0.01 up to 1:100 of the net free areas of the primary and secondary vents, respectively, helps to provide even smoother flow, as well as allowing any leakage to be directed back down through the spout, and then emptied out of the dispensing container. Thus, any leakage will not hinder the air flow upward, and the air pressure equalization still takes place, without any mess from the back leakage through the vents.

This concept of having at least one primary vent in the front of the cap, with at least one hole in the back is present in various aspects of the invention. Since this arrangement permits the equalization of air pressure, smooth flow is permitted during dispensing. Any backflow through any of the vents will merely flow through the spout and empty out along with the major flow of the effluent. This means that all the effluent would be emptied.

Looking still at FIG. 2A, the pouring spout generally denoted by the numeral 26 discloses novel integral air pressure equalizing vent holes 34 formed into pouring spout 36 that provide not only a path for displacement air to enter the container while liquid is simultaneously pouring through the pouring spout, but also a trickle path that redirects any spilling liquid back into the cavity of the pouring spout. This means that any spillage is merged into the liquid being dispensed, so it is also dispensed at the same time as the bulk of the liquid.

Figure 2C:
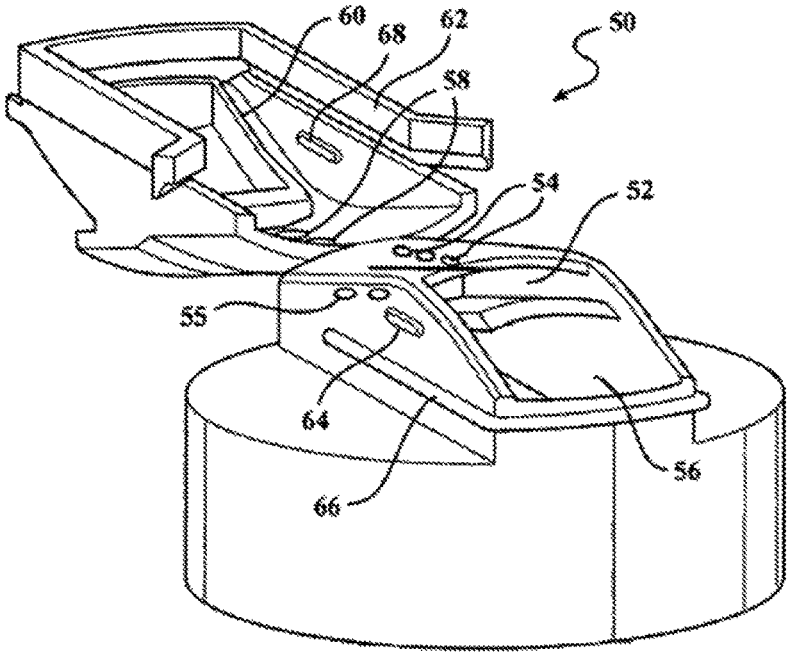
FIG. 2C is a perspective view of a self-venting air-displacement dispenser cap with a sealing cover made in accordance with the present invention.

FIG. 2C illustrates another aspect of the present invention which discloses a second cap, in this instance a hinged sealing cap, that is integral with my self-venting spout cap. Instead of using two pieces, i.e. like the previously disclosed harder durometer spout cap with its relatively softer durometer sealing cap, this aspect of the invention utilizes a hinged sealing cap that is hinged onto the self-vented spout cap via a living hinge. FIG. 2C shows this aspect of the integral piece with the entire assembly generally denoted by the numeral 50, and includes a primary vent 52 with at least one secondary vent(s) 54 venting out of the top. Optional side vents 55 may also be used to create airflow into the dispensing container. Vent hole plugs 58 are adapted to be received within secondary vent(s) 54 in the closed position to prevent spillage. The spout 56 itself releases effluent therethrough from the dispensing container. In this resealable aspect, prior to initial use, the hinged sealing cap 60 will be sealed for transport by tear-away seal strip 62. Furthermore, considering the fact that the hinged sealing cap 60 is sealed, this will also provide evidence of any tampering if the seal is broken during transportation.

In all of these aspects described herein, one must realize that the opening sizes of any of the orifices, whether an air inlet or a fluid outlet, the opening size may be infinitely variable. Although the air vents may be generally smaller than one another and smaller than the area of the outlet spout, it must be noted that the relative sizes of the air vents and the spout may be any ratio to work efficiently. For instance, the present invention works well if the square area of the spout is larger than the square area of the air vent.

Looking again to FIG. 2C, one can see that after the tear away seal strip 62 has been torn from the bottle, there can be a locking mechanism 64 located above a sealing strip 66 which is designed to receive the mating locking mechanism 68 in the closed position. Note that the configuration of the hinged sealing cap 60 is designed to perfectly complement the upper contours of the spout 56. In operation, one would strip off and remove the tear-away strip 62 by pulling on the end tabs, and then one would flip up the hinged sealing cap 60 in order to dispense the effluent out of the spout 56. When the user wants to reseal the dispenser bottle, he or she would flip the hinged sealing cap 60 back down over the spout 56 and push down to secure the locking mechanism 68 against the locking strip 64 in the spout cap. This will provide a leak resistant seal for further transportation of the bottle by the user/consumer.

Figure 2D:
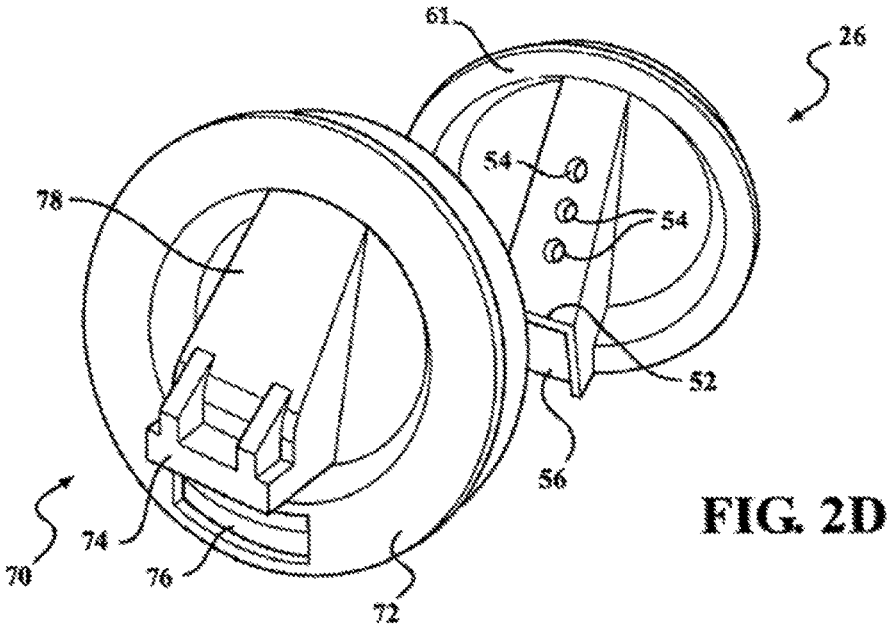
FIG. 2D shows a self-venting cap with a sealing cover made in accordance with the present invention.

FIG. 2D shows another aspect of the present invention which utilizes a two-piece cap system for venting and sealing a dispenser cap. The first piece is the self vented piece, generally denoted by the numeral 26 and including its primary vent 52 and secondary vents 54.

Primary vent 52 is located above spout portion 56 arising out of a bottom flange 61. Self vented piece 26 has the secondary vents 54 made out of the same integral piece. Secondary vents 54 may have any number of vents, but in this aspect of the invention, there are shown three secondary vents arising from and in communication with the primary vent 52. The second piece is a second cap, in this instance a sealing cap 70, and includes a top flange 72 which mates to the bottom flange 61 of self vented piece 26. This seal is leak resistant, and in certain aspect is watertight. The seal piece 78 is activated by a user pushing up on the seal piece balcony 74, exposing spout 76 during the operation. In this aspect of the invention, the sealing cap is self closing and may consist of different external shapes with at least one opening. There may be multiple caps, or a rotating top that can be twisted to expose various spouts and/or openings, as the application may require.

As shown in FIG. 2B, the backside of the self-venting 26 includes at least one vent hole which has a much smaller net free area of the primary vent than the total net free area of the secondary vents 54. It is this smaller open area in the vent holes through which the air is capable of venting into the dispenser container liquid in tiny bubbles. These little bubbles displace the liquid in the container, and allow the air pressure to equalize, which then allows the liquid to dispense out of the container in a smooth and even fashion. Effluent does not splash, nor do we achieve the "glug-glug" effect that we are trying to prevent.

Figure 2E:
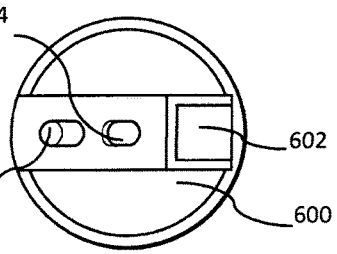
FIG. 2E shows another aspect of the present invention with both a primary vent and a secondary vent.
Figure 2F:
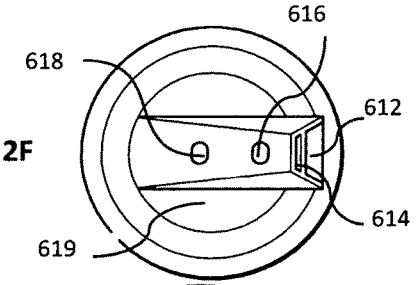
FIG. 2F illustrates another aspect.

Looking next to FIGS. 2E-2P, twelve (12) different aspects of the present invention are shown from the front of the cap. These aspects shown are meant to be illustrative of preferred aspects, and while these aspects work well for varying fluid dispensing, these aspects by no means shall limit the scope of the invention and the many aspects that are possible. As can be seen in FIGS. 2E-2P, starting from the upper left, FIG. 2E shows self-venting cap 600 having a relatively large spout 602 and a vent 604 in the top of the front of the cap, which is in communication with a hole vent 606 facing backward, shown in more detail hereafter. One can imagine vent 604 allows air in from the front of the cap through the vent, i.e. the outwardly facing cap piece, and then the air travels upward through the much smaller hole vent 606 facing into the liquid, such that the air bubbles rise to the top of the liquid level within the container and the liquid is displaced. This allows bubbles to rise up from the front of the cap through the container and equalize the pressure between the top of the container and the spout. In some of these aspects, displacement air bubbles may either be vented to the outside through a secondary vent, or the displacement air bubbles may be vented back into the fluid vessel through a primary vent, while in other aspects, the secondary vent may serve to urge overflow fluids into position so that the overflow fluid becomes dispensed into the container where the fluid is intended. Next, we look at FIG. 2F with the aspect shown in the cap 619 with the primary vent 612 serving as the spout coming from the top of the cap 619 so that any leakage out of the primary vent 612 is directed back so that the effluent ends up in the container into which it is being poured.

Figure 2G:
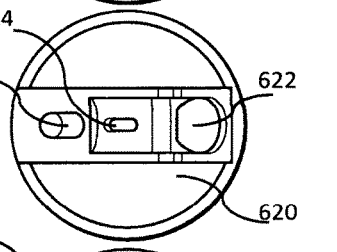
FIG. 2G shows another aspect with an elliptical spout and multiple vents.
Figure 2H:
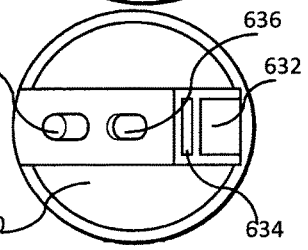
FIG. 2H illustrates another aspect with a different spout configuration.

In FIG. 2G, this illustrates yet another aspect of the self-venting feature, including a primary vent 622 acting as a spout with a secondary vent 624 aft of the spout. The aspect shown in FIG. 2H includes a separate primary vent along with some secondary vents and a drainage line to allow leakage back down through into the spout during pouring. Multiple orifices may be included for venting action, and may further include a nipple at the top of the vent to seal the hole in the sealing cap. The sealing cap is not shown in this picture. Yet another aspect of the present invention shows a dual vent cap. In one of the aspects, a primary vent is shown within the spout region. Another system with vents on lop of the vent piece is also shown.

The present invention has many and varied aspects for achieving the best result of a self-venting dispenser cap in accordance with the invention. The following drawing descriptions attest to some of the many different aspects that have been found to be useful for free flowing of liquids though the dispensing spouts, as illustrated. Some of these aspects shown in FIGS. 2E-2P utilize a single primary vent, and some of the aspects utilize both a primary vent and a secondary vent. Depending upon the viscosity of the fluid being dispensed, it may be most advantageous to incorporate the use of a secondary vent in combination with a primary vent.

Figure 2I:
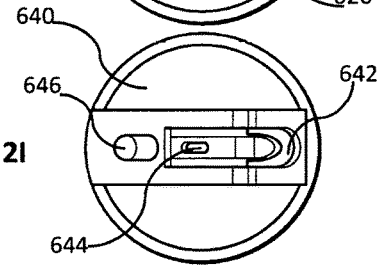
FIG. 2I illustrates another aspect with a rounded spout.
Figure 2J:
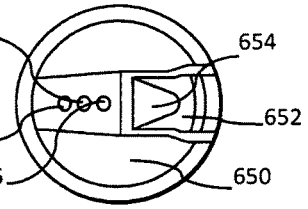
FIG. 2J illustrates another aspect with multiple top vents.
Figure 2K:
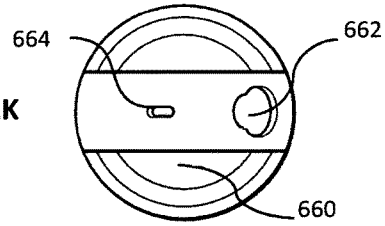
FIG. 2K illustrates another aspect with a primary vent.
Figure 2L:
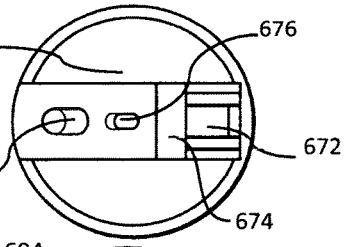
FIG. 2L illustrates another aspect with a square spout.
Figure 2M:
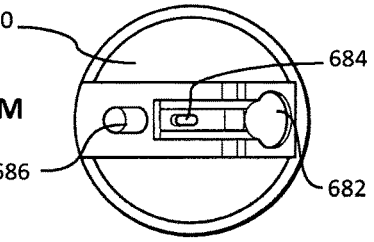
FIG. 2M illustrates another aspect with an elliptical spout design.
Figure 2N:
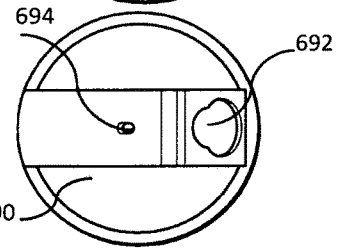
FIG. 2N illustrates another aspect another configuration with a primary vent.
Figure 2O:
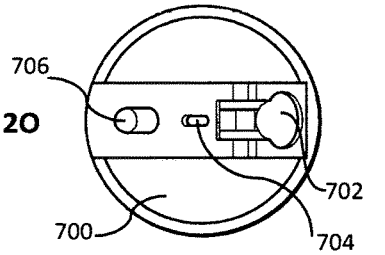
FIG. 2O illustrates another aspect another spout design.
Figure 2P:
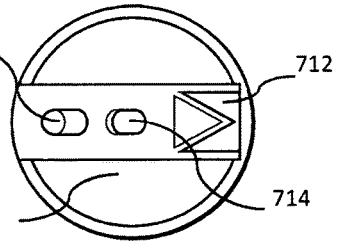
FIG. 2P illustrates another aspect with another spout design.

In that regard, another aspect of the present invention is shown in FIG. 2I, including spout cap 640 with a primary vent 642 being vented at the top by top vent 644 and enabled by a secondary vent shown as hole vent 646 for easy dispensing. FIG. 2J Shows at yet another aspect of the present invention with multiple top vents 656 in communication with spout 652 on top of spout 650. A secondary vent 654 allows for air displacement and easy dispensing of a fluid. FIG. 2K shows another aspect with an elliptical spout 662 on top of spout 660, and being vented by hole vent 664. FIG. 2L shows yet another aspect with a spout 672 having a secondary event 674 on top of spout 672, and being vented by top vent 676 and hole vent 678. FIG. 2M illustrates another aspect with an elliptically shaped spout 682 and vented by top vent 684 and hole vent 686 on top of cap 680. FIG. 2N shows a spout cap 690 with an elliptically shaped spout 692 and a singular top vent 694. FIG. 2O Is yet another configuration of the self venting cap made in accordance with my present invention including a spout 700, and elliptically shaped spout 702, wherein the dispenser is being vented by a top vent 704 and hole vent 706. Lastly, FIG. 2P shows a V-shaped spout 712 vented by a top vent 714 and a hole vent 716 on top of a spout cap 710.

Figure 3A:
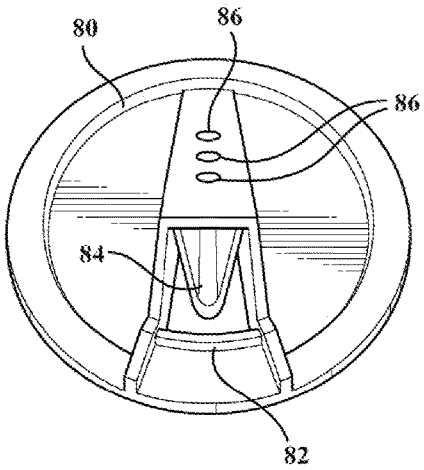
FIG. 3A more clearly defines the venting holes of one aspect of the present invention.
Figure 3B:
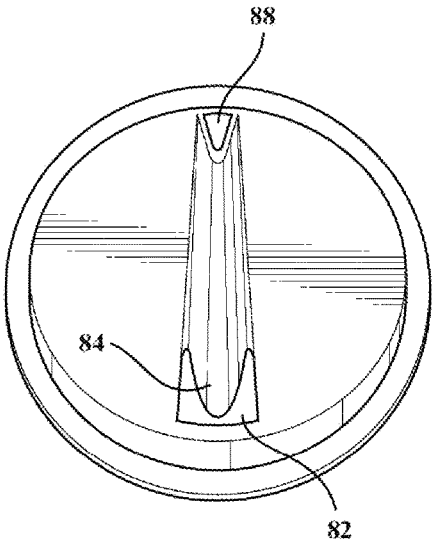
FIG. 3B shows the back side of the venting holes.

FIG. 3A illustrates a particular aspect of the present invention in which the self-venting cap is illustrated in a frontal configuration where the orientation of the primary vent 84 is clearly within spout 82. Primary vent 84 is in environmental communication with multiple vent holes 86 to allow venting from the front of the cap on the outside of the container to the inside of the container. FIG. 3B shows the back of the cap, where upper vent hole 88 allows air from the outside of the container via primary vent 84 to enter into and rise to the top of the container. Spout 82 is an open drain to allow effluent from within the container to be dispensed. Spout 82 is independent from vent 84. Air is emitted into primary vent 84, while liquid is being dispensed through spout 82.

Figure 3C:
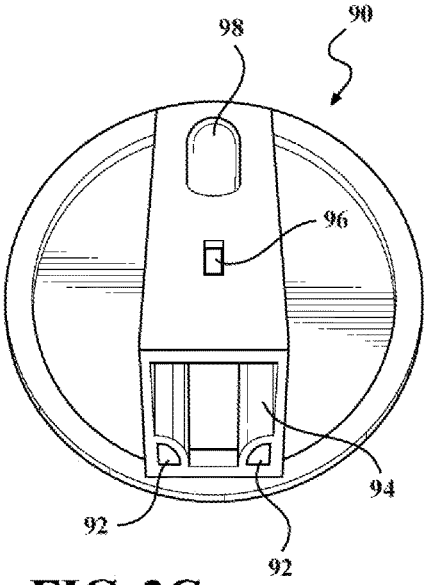
FIG. 3C shows another aspect of the vent holes of the present invention.
Figure 3D:
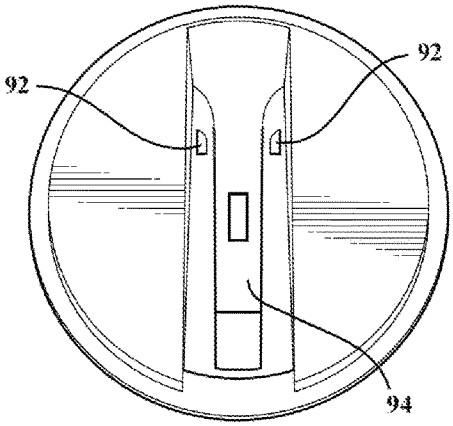
FIG. 3D shows yet another aspect of the vent holes of the present invention.

FIG. 3C shows yet another aspect of the invention, generally denoted by the numeral 90. This cap configuration includes a pair of primary vents 92 with the secondary vent 96 on top of the vent cap. The spout 94 is once again independent from the primary vents 92. A sealing nipple 98 is to be used to plug a hole in the sealing cap, if utilized. FIG. 3D shows the back of the cap of FIG. 3C, and further illustrates the exit of the secondary vents 92 and its relative placement with regard to vent 94.

Figure 4A:
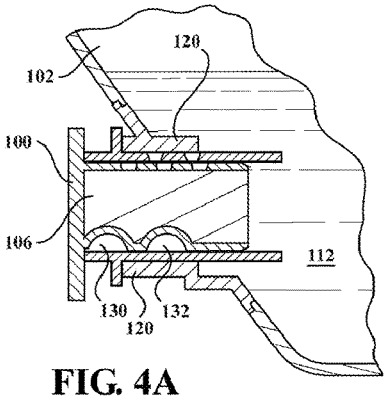
FIGS. 4A and 4B show another aspect of the self-venting air-displacement openings, both in the closed position and the open position, respectively.
Figure 4B:
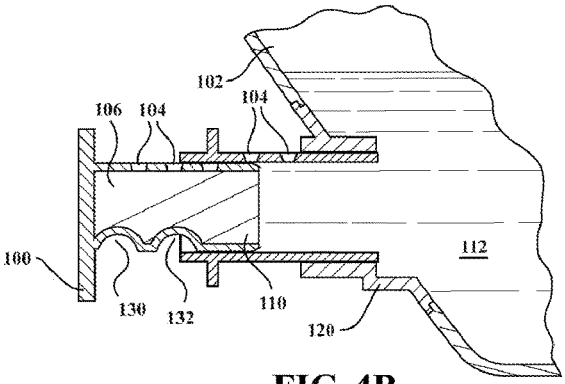

FIGS. 4A and 4B will collectively illustrate yet another aspect of the present invention, including a push-pull opening and closing mechanism utilizing the present invention concept of self venting. FIG. 4A shows a push-pull self-venting cap 100 in a "closed" configuration, thereby preventing effluent 120 from leaving container 102, while FIG. 4B shows the same push-pull mechanism, but this time, it is in the "open" position, such that multiple air openings 104 can help facilitate air venting into container 102 to displace the liquid 112 to be dispensed out of container 102. Note that the air vent 106 is independently and physically separated from the water spout, so the chance of blockage is absolutely minimized. A dispensing orifice 120 integral within container 112 is in a watertight relationship with push-pull cap 100.

Looking again at FIG. 4B, one can see that once cap 100 is in the "open" position, air can come into container 112 through multiple air openings 104 and move up through air vent 106 to displace liquid 102 at the top of container 112. As air rises, this air rushing into container 102 will result in displacement of the effluent 112 at the top of container 102, allowing effluent liquid 102 to be dispensed. Dispensing orifice 120 is permanently sealed into container 112 and slidably receives the push-pull mechanism 100 to be reciprocally and slidably mounted therein. Note that this aspect of the invention shows its air-displacement orifice 130 to be distal from effluent opening 132, where the effluent 112 leaves container 102 and is dispensed.

Figure 5:
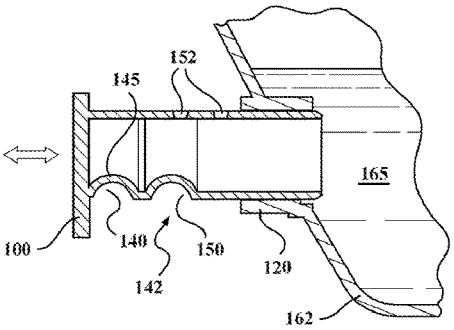
FIG. 5 shows yet another aspect of the push-pull vent with multiple air openings.

Looking next to FIG. 5, yet another aspect of the present invention is shown with push-pull cap 100 being in a slidably mounted relationship with orifice opening 120. In this aspect showing, container 162 having effluent 165 therein also contains an orifice opening 120 which is integral with container 162 and receives the slidably mounted push-pull cap 100. In operation, cap 100 is pulled out from the container, which leaves water orifice 145 and air opening orifice 152 opened to the environment. Air orifice opening 150 and water orifice opening 145 are now exposed, allowing air to come in through air vent openings 152. Once air comes into air vents 152, air comes into the container and displaces liquid effluent 165, which will release effluent 165 through water orifice opening 145. In this particular aspect, the air opening 142 is located more proximal than water opening 145. In certain circumstances, this particular configuration may be more advantageous depending upon the application of the present invention.

Figure 6:
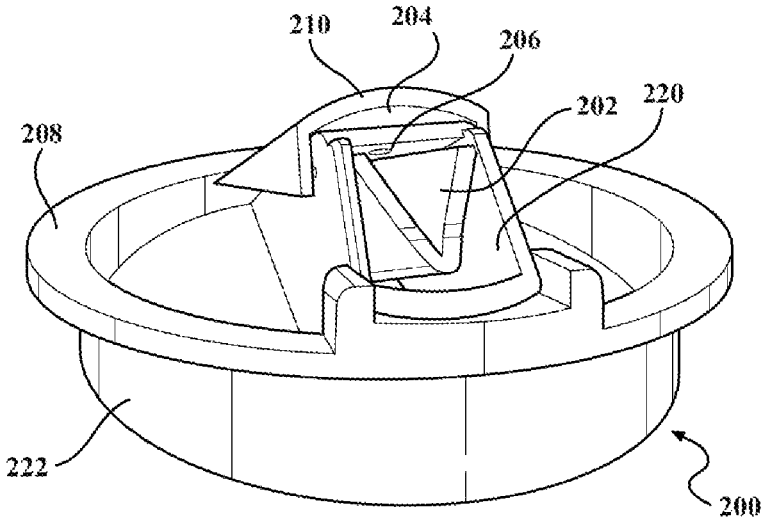
FIG. 6 is a front perspective view of a dispensing cap shows another aspect of the vent holes of the present invention.

FIG. 6 illustrates yet another aspect of the present invention including the use of an anti-contamination configuration. Numeral 200 generally denotes a new type of hooded cap, still including a primary vent 202 and a series of secondary vents 204. A hole 206 in the top of the spout 220 can be resealed by pushing down on hood 210 such that the hole 206 can be sealed. Hood 210 can cover the openings, and provide a means for eliminating dust and contamination, and gases are not able to be released through the secondary vent holes 204 in the event that this cap is used where there may be some undesirable gases that may be emitted. Flange 208 is intended to seal up around the opening in the dispensing container (not shown). In this aspect of the invention, insert 222 will protrude into the dispensing container providing a seal against flange 208. In this aspect, it would be advisable to use a secondary sealing cap over this hooded cap in order to provide a water resistant seal. Hood 210 can be snap fitted into place, over molded or can be ultrasonically welded over the top of spout 220. This liquid retention system will provide a smoothly flowing effluent and will also provide a method for preventing outside contamination to the contents of the dispensing container. Because this system has too many applications to even list here, one can see the basic concept of our self-venting cap, with the addition of the anti-contamination hood 210.

Figure 7:
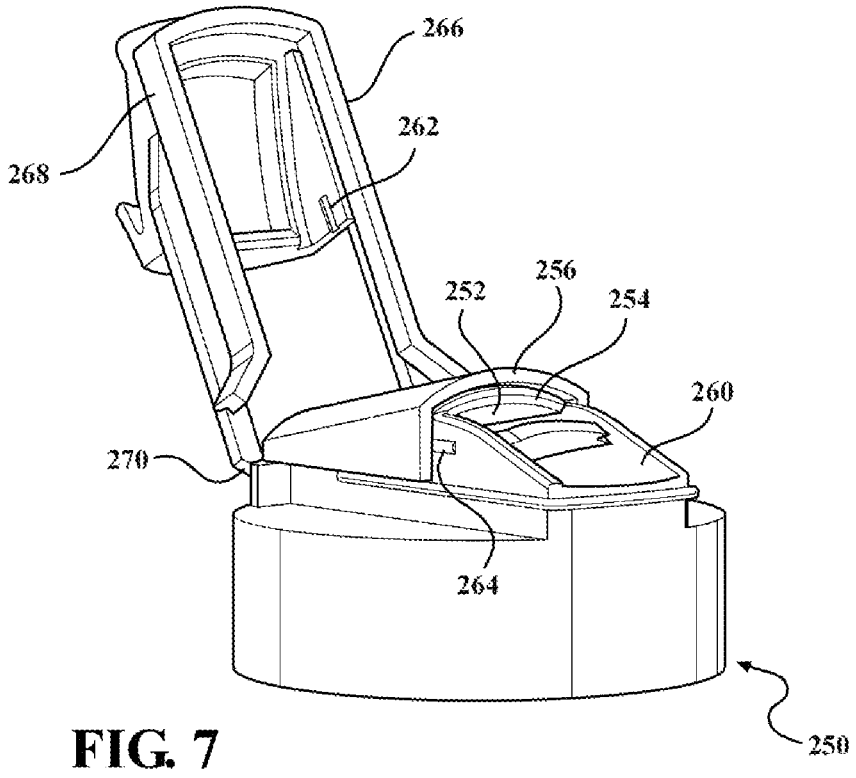
FIG. 7 is a perspective view of another aspect of the present invention with multiple vents located on the face with a sealing cover mating to the face to prevent leakage.

FIG. 7 is a perspective view of another described aspect of the present invention, resealable self-venting spout cap 250. Self-venting spout cap 250 includes a pouring spout 260, primary vent 252 and at least one secondary vent 254. As in previous aspects, there may be any number or location of either primary or secondary vents 254 in accordance with the present invention. Hood 256 may be attached to a resealable cap 266 which is attached to the resealable self-venting spout 250 by a living hinge 270 or the like. In order to close the self-venting spout cap 250, resealable cap 266 can be press-fit back down onto the self-venting spout cap 250 to achieve a water resistant seal. Optional male lock protrusion 262 is capable of mating with optional female lock indentations 264, keeping the resealable flange 268 in place for a water resistant seal of the self-venting spout cap 250. In this aspect of the present invention, there may be no need for an additional sealing cap to be placed over this self-venting spout cap 250 as it was in previously discussed aspects of the present invention.

Figure 8A:
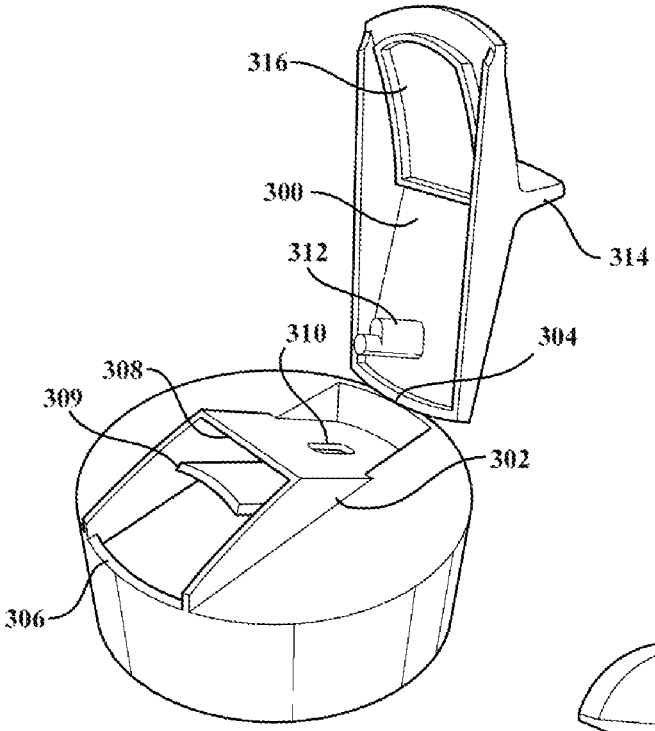
FIG. 8A is a top perspective view in an open position of one aspect of the invention.
Figure 8B:
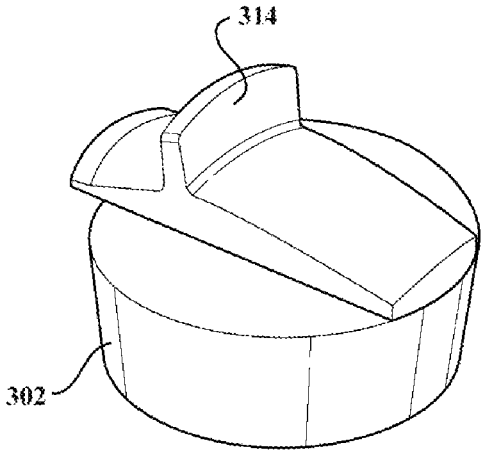
FIG. 8B is a top perspective view of the cap of FIG. 8A, but in a closed position.
Figure 8C:
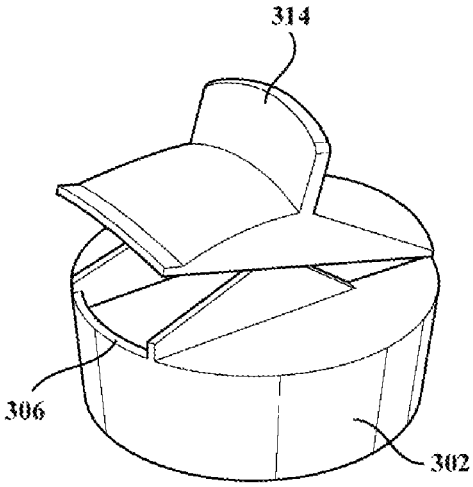
FIG. 8C shows the same aspect of the invention as in FIGS. 8A and 8B, although in a partially closed position.

FIGS. 8A-C illustrate yet another aspect of the present invention with a resealable cap 300 attached to a dispenser cap 302 with a living hinge 304. Dispenser cap 302 is affixed to an outer opening in a fluid or liquid dispenser container, and is intended to be an outlet emanating from the dispenser container for the fluid or liquid being dispensed. As before, dispenser cap 302 is adapted to be attached to a dispensing container for holding and dispensing any fluid, liquid or particulate that is to be dispensed therefrom. Typical fluids would include water, laundry detergent, wine, any type of powder or the like. Any fluid may be dispensed as such. Again, in order to effect the dispensing of the fluid from within the container, dispenser cap 302 includes a fluid or liquid spout 306 with an integral air inlet vent 308. Air inlet vent 308 and fluid or liquid spout 306 are separated by a membrane 309. Air inlet vent 308 and liquid spout 306 are preferably adjacent one another. Once dispensing begins, air rushes into air inlet vent 308 and passes therethrough to the interior of the dispensing container (not shown here). Air inlet vent 308 is in fluid communication with air opening 310 which is resealable with air opening plug 312, when resealable cap 300 is in the closed position. Resealable cap 300 may be activated by finger rest 314. FIG. 8A more closely details the seal 316 which is adapted to press fit within spout orifice 306, in order to effect the resealing. Therefore, resealable cap 300 blocks both the spout opening 306 and air inlet vent 308 when it is in the closed position. Looking at FIGS. 8 A-C again, plug 312 is also especially useful for clearing the opening 310 if it has become plugged with solidified material. For example, when such a dispenser is used for a liquid that becomes gummy or dries to a solid, oftentimes the liquid becomes gummy at opening 310, and plugs the opening, thereby preventing further dispensing. In this event, resealing plug 312 will clear the opening 310, and dispensing can resume. This "self-clearing" feature prevents air vents from buildup that would cause blockage and present problems.

Figure 9A:
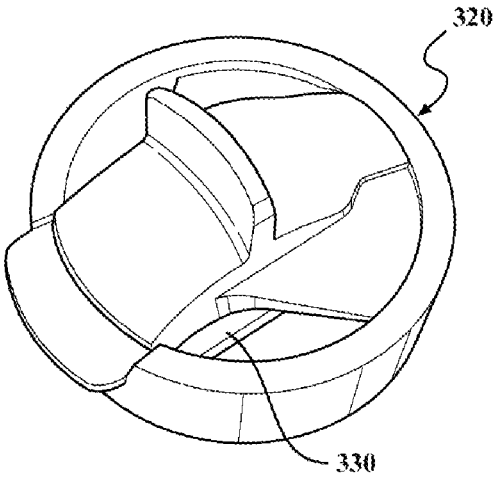
FIG. 9A illustrates yet another aspect of the present invention, comprising a two-piece construction.
Figure 9B:
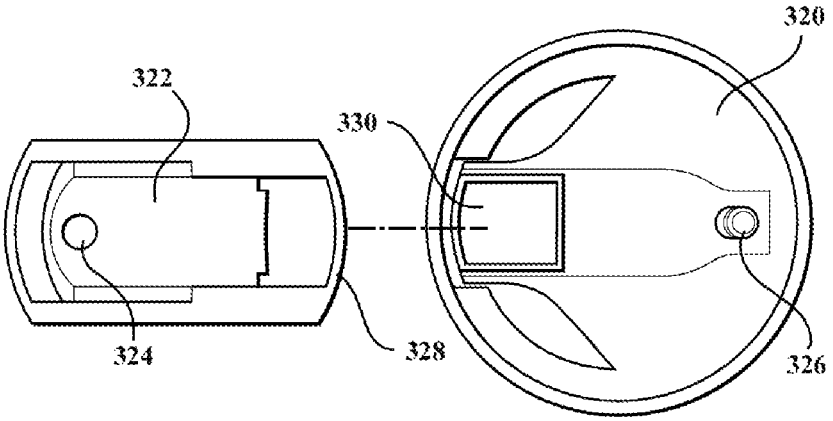
FIG. 9B shows the separated two pieces in a deconstructed format.
Figure 9C:
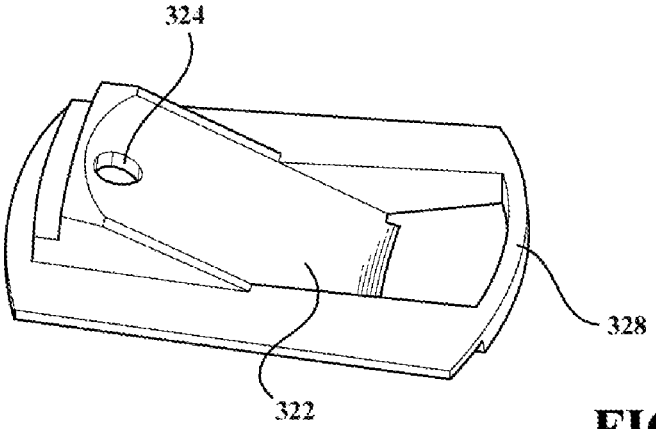
FIG. 9C is a top perspective view of the vented cap construction of the two-piece, which does not have the sealing cap shown thereon.

FIGS. 9A-9C illustrate various views of an overcap 320 made in accordance with the present invention which may optionally be used to reseal another aspect of self-venting dispenser cap 322. While FIG. 9A is a top perspective view of just the overcap 320, FIG. 9B shows overcap 320 from the bottom and self-venting dispenser cap 322. One can see an air vent opening 324 adapted to be plugged by air vent opening plug 326, when in the closed position. Self-venting dispenser cap 322 will be affixed to a dispenser container (not shown here) in a manner that spout 328 is suited for dispensing fluids out of the dispenser container. Overcap 320 includes a plug 326 and a resealer 330 that will reseal the air vent opening 324 and spout 328 when in the closed position. Overcap 320 may also be used to reseal a dispenser cap as shown in FIG. 8A, without the integral resealing cap 300.

Figure 10A:
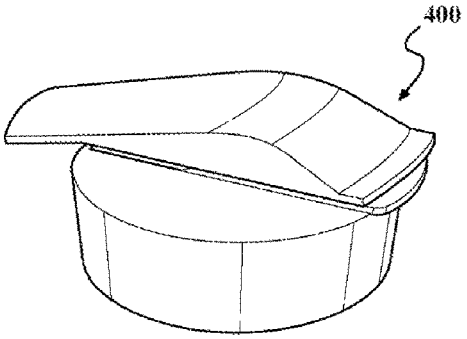
FIG. 10A shows yet another aspect of the present invention with an enlarged toggle cap.
Figure 10B:
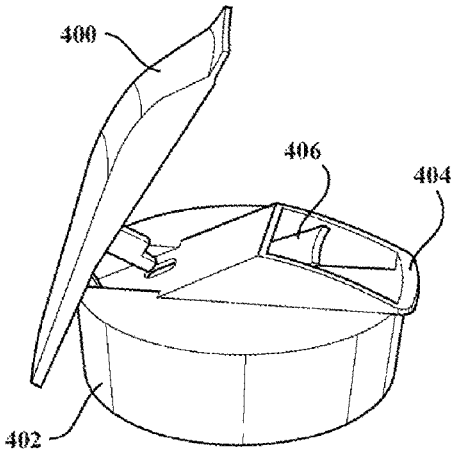
FIG. 10B shows the aspect of the invention with the toggle cap in an open position.
Figure 10C:
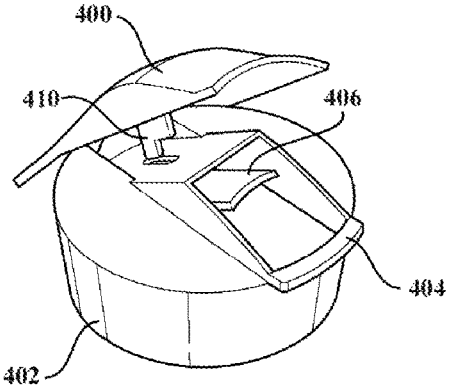
FIG. 10C shows the same aspect as FIGS. 10A and 10B, but within a semi-closed position, showing the placement of the vents.
Figure 10D:
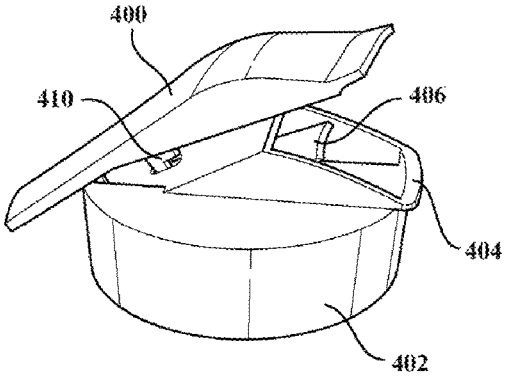
FIG. 10D shows the same aspect as FIGS. 10A-10C, and illustrates the hinge location for the toggle.

FIGS. 10A-C collectively illustrate various views of another aspect of the present invention which includes a somewhat larger hinged resealable cap 400 that may be easier to operate than some of the other aspects. Hinged resealable cap 400 is shown hinged onto dispenser cap 402. Hinged resealable cap 400 is adapted to reseal both spout 404 and air vent opening 406 when in the closed position. Although the present aspect includes two hinge pins 410 received within dispenser cap 402, any type of attachment is possible, including a living hinge or other suitable hinge mechanism.

Figure 11A:
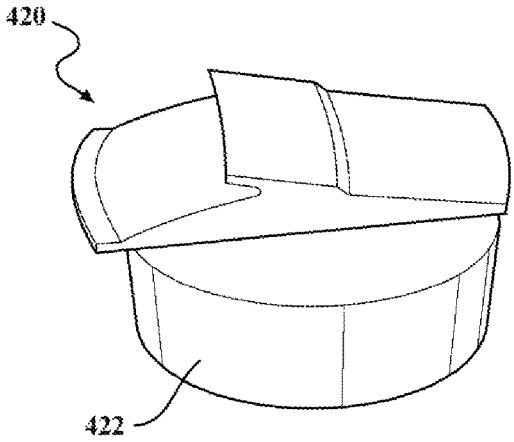
FIG. 11A shows yet another aspect of the present invention, in a closed position.
Figure 11B:
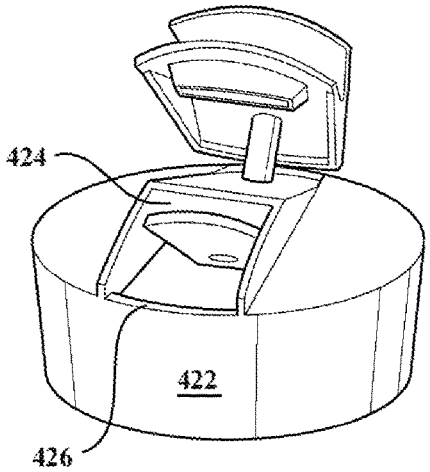
FIG. 11B shows a perspective view of the aspect of FIG. 11A with the sealing cap in a partially open position.
Figure 11C:
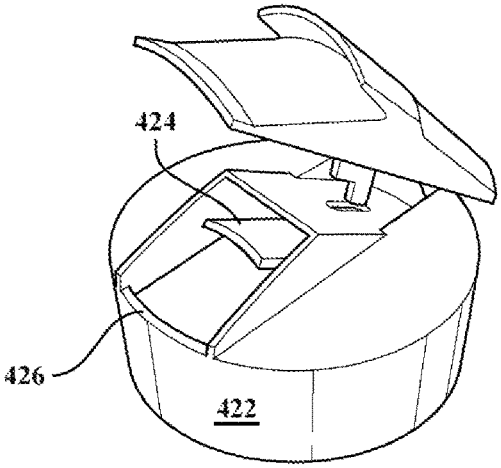
FIG. 11C is another angular view of the cap of FIG. 11B.

Looking now to FIGS. 11 A-C, they illustrate yet another aspect of a resealable cap 420 made in accordance with the present invention. Although very similar to the cap shown in FIGS. 10 A-C, the aspect shown here in FIGS. 11 A-C is not as long as the one in FIGS. 10 A-C, thereby saving material and time during manufacture. Hinging mechanisms are similar, as well as the sealing mechanisms for sealing air vent opening 424 and spout 426.

Figure 12A:
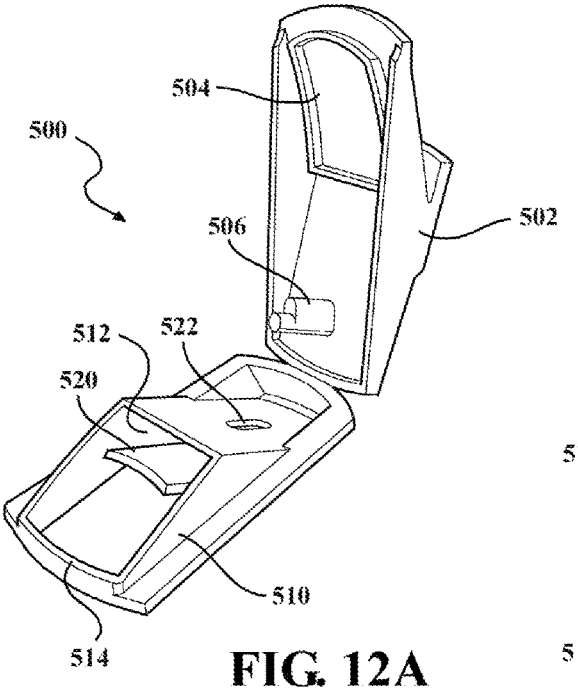
FIG. 12A shows yet another aspect of the invention with a living hinge sealing cap and vented container pouring spout.
Figure 12B:
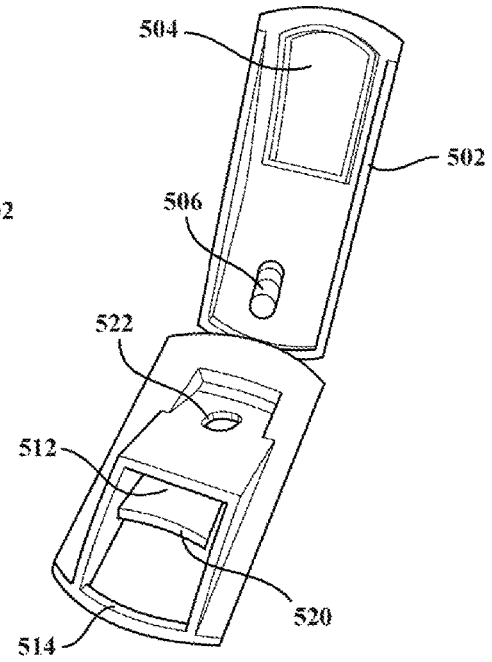
FIG. 12B is another view of the cap of FIG. 12A.
Figure 12C:
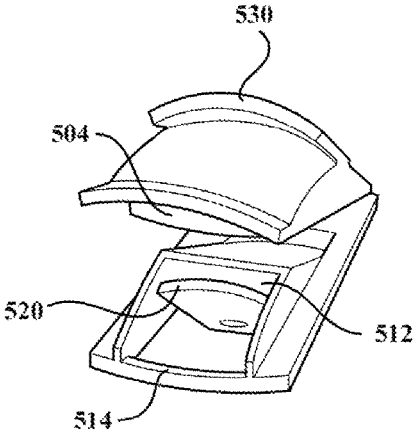
FIG. 12C is a top perspective view of the sealing cap aspect of the invention in accordance with FIGS. 12A-12C.
Figure 12D:
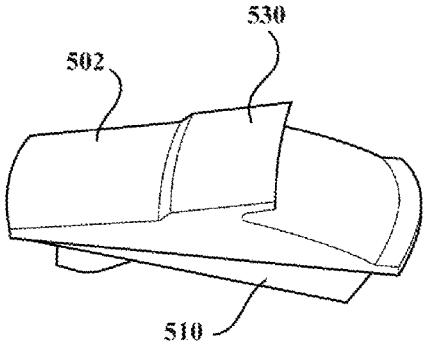
FIG. 12D shows the sealing cap of FIGS. 12A-12C in a closed position.

Referring last to FIGS. 12A-D, there is shown another aspect of the present invention with a dispenser cap and resealable cap combination as generally indicated by numeral 500. Dispenser cap 510 has formed therein an air vent opening 512, similar in function to previously described aspects hereinabove. The air vent opening 512 is separated from a fluid outlet spout 514 by a membrane 520, again similar to previous aspects. Distal from the spout 514 is a secondary air vent 522, which is adapted to be plugged and resealed by plug 506 when resealable cap 502 is in the closed position over dispenser cap 510. A sealing portion 504 is also adapted to plug the spout 514 when cap 510 is press fitted into a closed position. Finger rest 530 of FIG. 12C is shown when the resealable cap 510 is closed, and the cap may be urged open by mechanical pressure to be applied by the thumb or fingers of an operator. Such a dispenser cap may be utilized on TetraPak® type containers (not shown here), as they are commercially utilized for packaging liquids such as soups, juices, broths, and the like. TetraPak® is a registered trademark of Tetra Pak, Inc. of Denton, Tex. These packages exhibit the classic non-smooth flow when contents of the containers are dispensed. In other words, such TetraPak® containers go "glug-glug" when you pour out its contents. To reseal the dispenser cap 510 of the present invention, one merely pushed the resealable cap 502 down onto the dispenser cap 510, and it is press fit together to reseal the container.

Still looking at FIGS. 12 A-D, plug 506 is also especially useful for clearing the opening 522 if it has become plugged with solidified or gummy material. For example, when such a dispenser is used for fabric softener, oftentimes the fabric softener becomes gummy at opening 522, and plugs the opening, thereby preventing further dispensing. In this event, resealing plug 506 will clear the opening 522, and dispensing can resume.

It is clear from the numerous illustrations of various aspects shown above that there are many other aspects of the present invention that can be embodied by the basics of the present concept, i.e. my self-venting spout. Most of the aspects include a spout, and at least one air vent that occurs within the cap of the dispensing container to provide smooth flow of effluent out of the dispensing container through the spout. Some of the aspects include integral resealing caps, while others have utilized a secondary sealing cap to be placed over the working spout cap with a self vent. However, it should be known that there are many aspects and embodiments that have not been described in detail within this patent application, but nevertheless are within the spirit and vision of the present inventor.

Therefore, the container and dispensing industries now have been provided with many various new self-venting cap arrangements that solve many of the problems that the industry has had in the past. Manual venting systems have caused problems in the past because the venting location will not allow the container to be laid on its side, thereby rendering the containers to be unusable in certain circumstances. The present invention solves that problem quite nicely. As mentioned above, this particular dispensing arrangement can be utilized on any scale, from small water bottles up to tanker trucks and barge covers for oceangoing vehicles. Again, as described hereinabove, the caps and seals can be activated automatically and remotely either mechanically, pneumatically, hydraulically, electrically, or by any other suitable means for activating the sealing and resealing of the orifices. Solenoid valve activation may also be employed to open or shut the spout and/or vents. Such a solenoid valve would most likely be utilized in a commercial application, although it could find utility in almost any application.

Clearly, in the future, this concept of self-venting and air-displacing ports and vents will find wide applicability throughout many industries, and the aspects shown in the present patent application will be modified and altered to become more suitable for the particular application. This will not deviate from the spirit of the present invention, although some of the aspects are not shown in the drawings of the present patent application. One of ordinary skill in the art will appreciate the size and number of openings necessary for every application, so that the end invention disclosed in this patent application shall not be limited by the illustration of a few aspects in the drawings attached hereto.

Further, minor modifications and alterations to the present invention will also fall under the scope and protection of this patent application, while various activation mechanisms, orifice opening configurations, and vent applications are all to be included in the scope of this invention and the protections afforded thereto. Regardless of the shape and or size of the container of the effluent, my self-venting concept will be applicable. The nature of the effluent, for instance the viscosity and/or the consistency, may determine the location of the orifices and the style and aspect of the self-venting cap to be used for maximum air displacement to allow for smooth and rapid emptying of the effluent out of the container.

Although it is not shown in the diagrams, any conceivable orifice opening configuration is envisioned by the present inventor to be included within the scope of this invention, along with any of the activation mechanisms that are currently commercially available on the market for such an activity. One can imagine that any electrical activation mechanism could be utilized in the one-piece flip top and vent-cap arrangement shown herein above with reference to various figures. An electrical device could be used to flip up the sealing cap, and another electrical device could be used to reseal the sealing cap. Furthermore, a pneumatic activation mechanism could also be used to flip up the flip top and then another additional pneumatic system could be used to reseal the sealing cap. Pneumatic devices could also be used to open the push-pull mechanism illustrated in FIGS. 4A, 4B and 5, and a vacuum retraction system might be utilized for pulling the push-pull mechanism back inward into the container. If the present invention is to be used in tanker cars to be hauled by truckers, a vacuum system could be used to retract any mechanical activation, including a push-pull mechanism or any other appropriate mechanism, once it had been opened by an operator, usually the truck driver himself.

In addition, although not shown in drawings, a magnetic sealing system could be utilized by activating an electromagnetic motor which could open the orifice thereby allowing effluent out, and reversing the polarity of the motor could reseal the orifice. Such a magnetic activation mechanism could be highly advantageous within a shop floor configuration as it could be not only on and off regulated, but it could be activated to be partially on and partially off, which may find utility in a dispensing effluent into manufacturing of various chemicals, recipes and bakeries, mixing of paint factory, or any other application which may need to have partial dispensing liquids out of a tanker or container.

Lastly, and again not shown in drawings, the present inventor envisions other modifications and alterations to the activation and orifice configurations for many applications in other industrial settings. Hydroelectric dams and other water retention systems could also find utility for the present invention, or a sealed container may be the center of the operation. It may or may not be advantageous to an operator of such a system to include a vented system at the top, while the present invention may allow dispensing of an effluent from the orifice opening at the bottom of the container.

Therefore, one can see that there are many applications for the present invention and there are many modifications and alterations which can be envisioned by the present inventor, and he desires that these applications be provided the protections within the scope of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims which are appended hereto.

What is claimed is:

1. An air-displacing vented dispenser cap for attachment to a dispenser container that contains liquid to be dispensed, comprising:

a dispenser cap with a primary orifice that is a liquid dispensing spout outlet and a plurality of separate air inlets defining an air flow passageway to act as a vent for the air to enter the inside of the dispenser container on which the dispenser cap would be mounted;

said liquid dispensing spout outlet having a preselected spout opening cross-sectional area and performing a function of a spout from which the liquid is dispensed; and each of the separate air inlets having a preselected inlet opening cross-sectional area performing a function of allowing air to ingress into the dispenser container to provide air displacement, thereby allowing liquid to egress through the liquid dispensing spout outlet smoothly;

wherein the liquid dispensing spout outlet and the plurality of separate air inlets are adjacent one another, but positioned so that the plurality of air inlets will not be covered with liquid from the inside dispenser during the dispensing operation.

2. The dispenser cap of claim 1, wherein the plurality of air inlets includes a primary vent and at least one secondary vent, and the ratio of the cross-sectional area of the primary vent to a sum of the cross-sectional area of the at least one secondary vent is larger than 1.

3. The dispenser cap of claim 2, wherein the liquid dispensing spout outlet is disposed under the primary vent.

4. The dispenser cap of claim 1, wherein the liquid dispensing spout outlet is selected from the group consisting of a round outlet, a rectangular outlet, a triangular outlet or a combination of these shapes of outlets.

5. The dispenser cap of claim 1, wherein the liquid dispensing spout outlet and the plurality of air inlets are formed into a single piece integral component.

6. The dispenser cap of claim 1, further comprising a hinged sealing cap for the resealing the liquid dispensing spout outlet.

7. The dispenser cap of claim 1, further comprising a hinged sealing cap for resealing the plurality of air inlets, said hinged sealing cap comprising a flexible polymeric material.

8. The dispenser cap of claim 1, further comprising a self-clearing plug that clears the vent from any buildup of liquid.

9. An air-displacing vented dispenser cap for attachment to a dispenser container that contains liquid to be dispensed, comprising:

a dispenser cap with a primary orifice that is a liquid dispensing spout outlet and a secondary orifice that is a separate air inlet defining an air flow passageway to act as a vent for the air to enter the inside of the dispenser container on which the dispenser cap would be mounted;

said liquid dispensing spout outlet having a preselected spout opening cross-sectional area and performing a function of a spout from which the liquid is dispensed; and said separate air inlet having a preselected inlet opening cross-sectional area performing a function of allowing air to ingress into the dispenser container to provide air displacement, thereby allowing liquid to egress through the liquid dispensing spout outlet smoothly;

wherein the liquid dispensing spout outlet and the separate air inlet are adjacent one another, but positioned so that the air inlet will not be covered with liquid from the inside dispenser during the dispensing operation; and wherein the liquid dispensing spout outlet, further comprising an externally extending flexible flange made of a polymeric material configured to seal with a second cap.

10. An air-displacing vented dispenser cap and second cap combination for attachment to a dispenser container that contains liquid to be dispensed, comprising:

a dispenser cap with a second cap for resealing a primary orifice that is a liquid dispensing spout outlet and a plurality of separate air inlets defining an air flow passageway to act as a vent for the air to enter the inside of the dispenser container on which the dispenser cap would be mounted;

said liquid dispensing spout outlet having a preselected spout opening cross-sectional area and performing a function of a spout from which the liquid is dispensed;

each of the separate air inlets having a preselected inlet opening cross-sectional area performing a function of allowing air to ingress into the dispenser container to provide air displacement, thereby allowing liquid to egress through the liquid dispensing spout outlet smoothly;

wherein the liquid dispensing spout outlet and the plurality of separate air inlets are adjacent one another, but positioned so that the air inlet will not be covered with liquid from inside the dispenser during the dispensing operation.

11. The dispenser cap of claim 10, wherein the plurality of air inlets includes a primary vent and at least one secondary vent, and the ratio of the cross-sectional area of the primary vent to a sum of the cross-sectional area of the at least one secondary vent is larger than 1.

12. The dispenser cap of claim 11, wherein the liquid dispensing spout outlet is disposed under the primary vent.

13. The dispenser of claim 10, wherein the liquid dispensing spout outlet is selected from the group consisting of a round outlet, a rectangular outlet, a triangular outlet or a combination of these shapes of outlets.

14. The dispenser cap and second cap of claim 10, wherein the liquid dispensing spout outlet and the plurality of air inlets are formed into a single piece integral component.

15. The dispenser cap and second cap of claim 10, wherein the second cap is a hinged sealing cap for resealing the liquid dispensing spout outlet.

16. The dispenser cap and second cap of claim 10, wherein the second cap is a hinged sealing cap for resealing the plurality of air inlets, said hinged sealing cap being made of a flexible polymeric material.

17. The dispenser cap and second cap combination of claim 10, further comprising a self-clearing plug that clears the vent from any buildup of liquid.

18. An air-displacing vented dispenser cap and second cap combination for attachment to a dispenser container that contains liquid to be dispensed, comprising:

a dispenser cap with a second cap for resealing a primary orifice that is a liquid dispensing spout outlet and a secondary orifice is a separate air inlet defining an air flow passageway to act as a vent for air to enter the inside of the dispenser container on which the dispenser cap would be mounted;

said liquid dispensing spout outlet having a preselected spout opening cross-sectional area and performing a function of a spout from which liquid is dispensed;

said separate air inlet having a preselected inlet opening cross-sectional area performing a function of allowing air to ingress into the dispenser container to provide air displacement, thereby allowing liquid to egress through the liquid dispensing spout outlet smoothly;

wherein the liquid dispensing spout outlet and the separate air inlet are adjacent one another, but positioned so that the air inlet will not be covered with liquid from inside the dispenser during the dispensing operation, and wherein the liquid dispensing spout outlet further comprises an externally extending flexible flange made of a polymeric material configured to seal with the second cap.

* * * * *